US006332873B1

(12) United States Patent
Naruse et al.

(10) Patent No.: US 6,332,873 B1
(45) Date of Patent: Dec. 25, 2001

(54) HAND-HELD MASSAGING APPARATUS

(75) Inventors: Haruhiko Naruse, Hikone; Koichi Hashimoto, Sakata-gun, both of (JP)

(73) Assignee: Matsushita Electric Works, Ltd., Kadoma (JP)

( * ) Notice: Subject to any disclaimer, the term of this patent is extended or adjusted under 35 U.S.C. 154(b) by 0 days.

(21) Appl. No.: 09/444,386

(22) Filed: Nov. 22, 1999

(30) Foreign Application Priority Data

Nov. 20, 1998 (JP) ..... 10-331360

(51) Int. Cl.[7] ..... A61H 1/00; A61H 7/00

(52) U.S. Cl. ..... 601/135; 601/134; 601/73; 601/72; 601/70; 601/69

(58) Field of Search ..... 601/67, 69, 70, 601/72, 73, 134, 135

(56) References Cited

U.S. PATENT DOCUMENTS

| | | | |
|---|---|---|---|
| 4,433,683 | | 2/1984 | McCoy et al. . |
| 4,878,489 | | 11/1989 | Kamahachi . |
| 5,117,815 | | 6/1992 | Gentry et al. . |
| 5,123,405 | | 6/1992 | McShirley et al. . |
| 5,123,406 | * | 6/1992 | Masuda ..... 601/72 |
| 5,193,528 | | 3/1993 | Iwamoto et al. . |
| 5,848,980 | * | 12/1998 | Demerais ..... 601/135 |

FOREIGN PATENT DOCUMENTS

| | | |
|---|---|---|
| 671 333 | 8/1989 | (CH) . |
| 42 07 285 | 8/1993 | (DE) . |
| 05-020730 | 3/1993 | (JP) . |
| 05-091676 | 12/1993 | (JP) . |
| 06-077730 | 11/1994 | (JP) . |
| 07-028549 | 5/1995 | (JP) . |

* cited by examiner

*Primary Examiner*—Michael A. Brown
*Assistant Examiner*—Benjamin Koo
(74) *Attorney, Agent, or Firm*—Oblon, Spivak, McClelland, Maier & Neustadt, P.C.

(57) ABSTRACT

A massaging apparatus including a head unit, a pair of housings and a pair of arms. The head unit is configured to massage a body of a user. The pair of housings are connected to opposite sides of the head unit respectively and extend in opposite directions from the head unit. The pair of arms are configured to be held by the user and provided to the pair of housings respectively. The pair of arms are flexible.

21 Claims, 6 Drawing Sheets

HAND-HELD MASSAGING APPARATUS

CROSS-REFERENCE TO RELATED APPLICATIONS

The present application claims priority under 35 U.S.C. §119 to Japanese Patent Application No. H10-331,360, filed Nov. 20, 1998, entitled "Massaging Apparatus." The contents of that application are incorporated herein by reference in their entirety.

BACKGROUND OF THE INVENTION

1. Field of the Invention

The present invention relates to a hand-held massaging apparatus.

2. Description of the Background

A hand-held massaging apparatus is disclosed in Japanese Unexamined Utility Model Publication (Kokai) 5-20,730, entitled "Massaging Apparatus." The contents of this application are incorporated herein by reference in their entirety. This massaging apparatus includes a rod member having a massaging portion on a mid section thereof and a strap attached to one end of the rod member. To obtain a back massage, a user grabs onto the strap with one hand and the other end of the rod member with the other hand so that the massaging portion is placed against a massaging spot or pressure point in her back. When the user pulls the strap and the other end of the rod member with both hands, the massaging portion is pressed against the massaging spot or pressure point and thus effectuates a massage.

However, the massaging apparatus described above has the following drawbacks. First, because the strap freely rotates with respect to the rod member, it is difficult to position the massaging portion against a precise massaging spot in a user's back. Furthermore, when the user pulls the strap and the rod member to obtain a massaging effect, she is likely to lose her massaging spot since it is difficult to maintain the same balance of force she applied to obtain the massaging spot. Similarly, to obtain a massaging effect in a waist or back area, the user must continue to pull the strap and the other end of the rod member, and it is thus extremely difficult to keep the massaging unit in the same massaging spot during her effort to massage her waist or back.

FIG. 7 shows another conventional massaging apparatus. This massaging apparatus includes a rod-shaped housing 2. A head unit 1 is provided on one end and a grip 3 is provided on the other end of the rod-shaped housing 2. The head unit 1 contains a thumping-type massaging mechanism which utilizes a solenoid. An arm 4 is slidably inserted in the housing 2 from the head unit 1. The arm 4 is flexible and another grip 3' is provided at an end of the arm 4. Thus, a user can pull out the arm 4 from the housing 2, and hold the grip 3 with one hand and the other grip 3' with the other hand. This construction allows the user to maintain massaging heads 10 in the head unit 1 onto her waist or back with ease.

Nevertheless, the massaging apparatus equipped with the arm 4 described above has a problem in terms of its usefulness. Because the housing 2 and arm 4 have different flexibilities, it is difficult to press the massaging portion 10 against a user's waist or back properly. Consequently, the massaging apparatus fails to massage symmetrically and thus to achieve an effective massage.

SUMMARY OF THE INVENTION

An object of the present invention is to provide a hand-held massaging apparatus which facilitates an effective massage.

The object is achieved according to the present invention by providing a novel hand-held massaging apparatus which includes a head unit, a pair of housings and a pair of arms. The head unit is configured to massage a body of a user. The pair of housings are connected to opposite sides of the head unit respectively and extend in opposite directions from the head unit. The pair of arms are configured to be held by the user and provided to the pair of housings respectively. The pair of arms are flexible.

BRIEF DESCRIPTION OF THE DRAWINGS

A more complete appreciation of the invention and many of the attendant advantages thereof will become readily apparent with reference to the following detailed description, particularly when considered in conjunction with the accompanying drawings, in which.

DETAILED DESCRIPTION OF THE PREFERRED EMBODIMENTS

Figure 1:
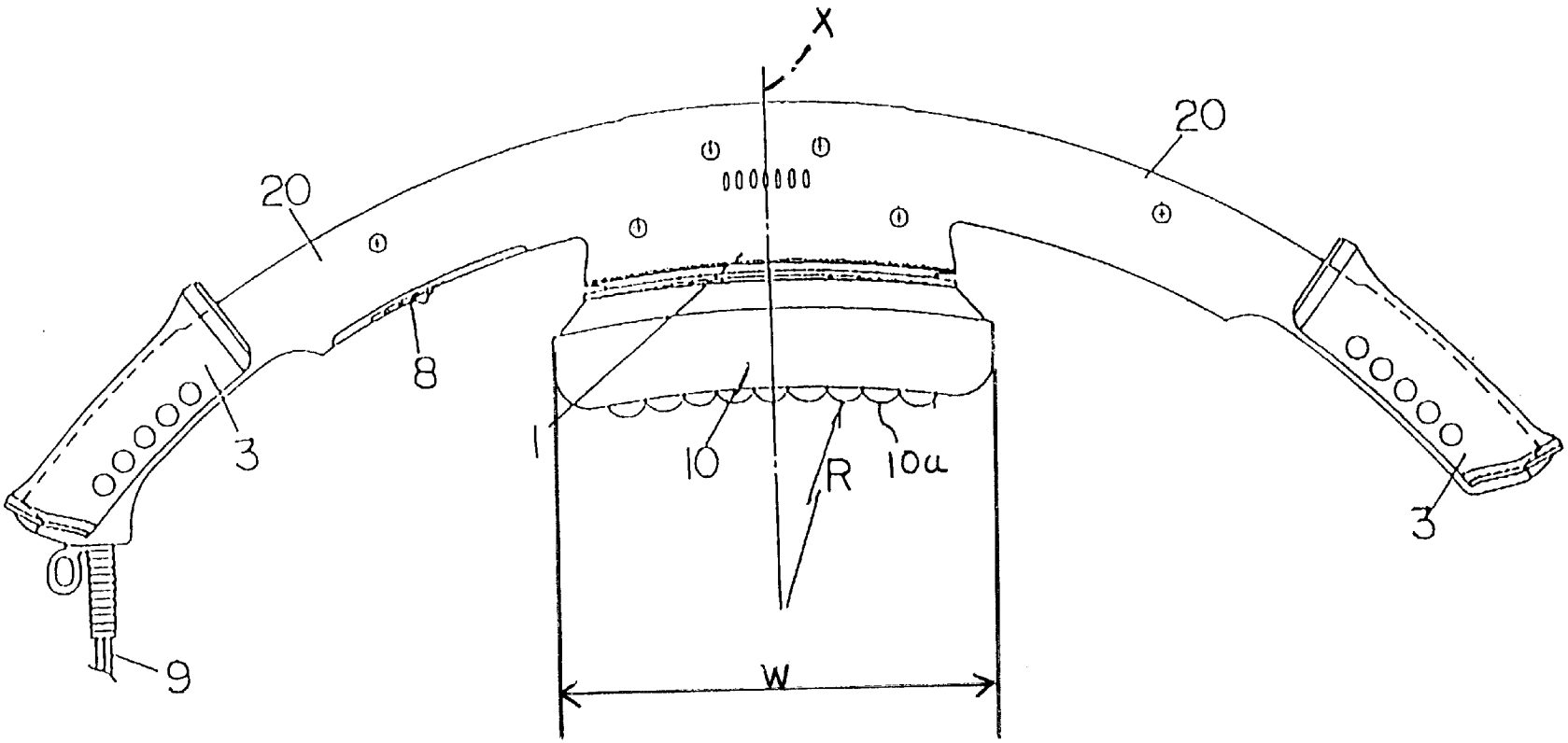
FIG. 1 is a top plan view of a hand-held massaging apparatus according to an embodiment of the present invention.

The preferred embodiments will now be described with reference to the accompanying drawings, wherein like reference numerals designate corresponding or identical elements throughout the various drawings.

Figures 2, 3:
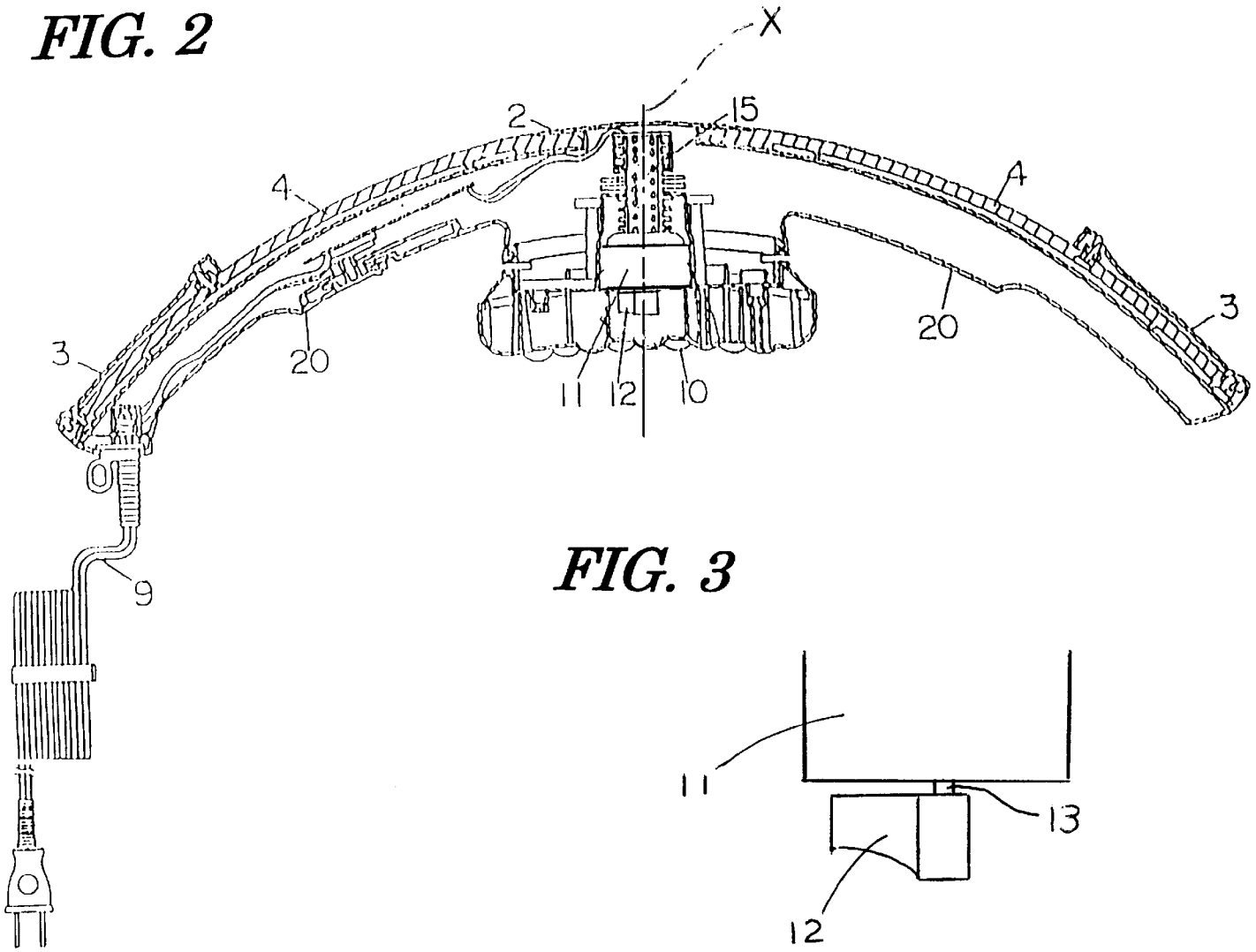
FIG. 2 is a cross-sectional view of the hand-held massaging apparatus shown in FIG. 1.
FIG. 3 is an enlarged view of a motor and an eccentric weight of the hand-held massaging apparatus shown in FIG. 2.

FIG. 1 is a top plan view of a hand-held massaging apparatus according to an embodiment of the present invention, and FIG. 2 is a cross-sectional view of the hand-held massaging apparatus. Referring to FIGS. 1 and 2, a head unit 1 includes a massaging mechanism. A massaging portion 10 which is to be placed against a user's massaging spot is provided on one side of the head unit 1. The massaging portion 10 may be made of rubber or any other elastic materials suitable for the purpose. Arc-shaped housings 20 extend from the right and left sides of the head unit 1 in a manner that the arc-shaped housings 20 partially surround a user's body (see FIG. 5). A grip 3 is provided at the end of each arm 4 (see FIGS. 4(*a*)–4(*c*)). In this embodiment, the arc-shaped housings 20 and a frame of the head unit 1 are formed integrally.

FIG. 3 is an enlarged view of a motor and an eccentric weight of the hand-held massaging apparatus. Referring to FIGS. 1–3, the massaging mechanism described above includes a motor 11 and an eccentric weight 12. The motor 11 is mounted on the head unit 1 through an elastic body 15. The eccentric weight 12 is connected with a rotating shaft 13 of the motor 11. Accordingly, the motor 11 rotates the eccentric weight 12 eccentrically. When a user places the massaging portion 10 against a massage spot, the rotation of the eccentric weight 12 delivers vibratory stimulation to the massage spot. Since a rotational axis (X) of the eccentric weight 12 is substantially perpendicular to a surface (10*a*) of the massaging portion 10 which is engaged with the user's massage spot, the vibratory stimulation described above creates rubbing feeling to the user. Also, as described above, because the motor 11 is mounted on the head unit 1 through the elastic body 15, there is hardly any vibration transmitted to the grips 3. Hence, even after a long period of use, the user will not feel numbness in her hands or get tired from holding the grips 3. In the present embodiment, a coil spring is used as the elastic body 15; however, a rubber, other elastomers or similar elastic materials which absorb vibration caused by the massaging mechanism can be used as the elastic body 15.

In the massaging mechanism utilizing the eccentric weight and motor as described above, because the rotational axis of eccentric weight is substantially perpendicular to a massaging area in contact with the massaging portion, the massaging portion vibrates in a direction substantially parallel to the massaging area. Such a massaging mechanism allows to massage large massaging areas such as a back and a waist at once, and to reduce its size as well.

Figure 4:
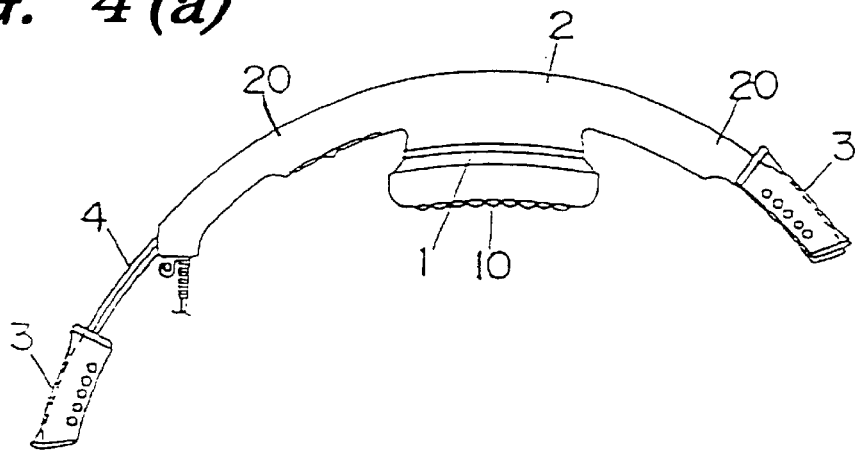
FIGS. 4(*a*)–4(*c*) illustrate three different states in which an arm is extended in the hand-held massaging apparatus shown in FIG. 1.
Figure 4:
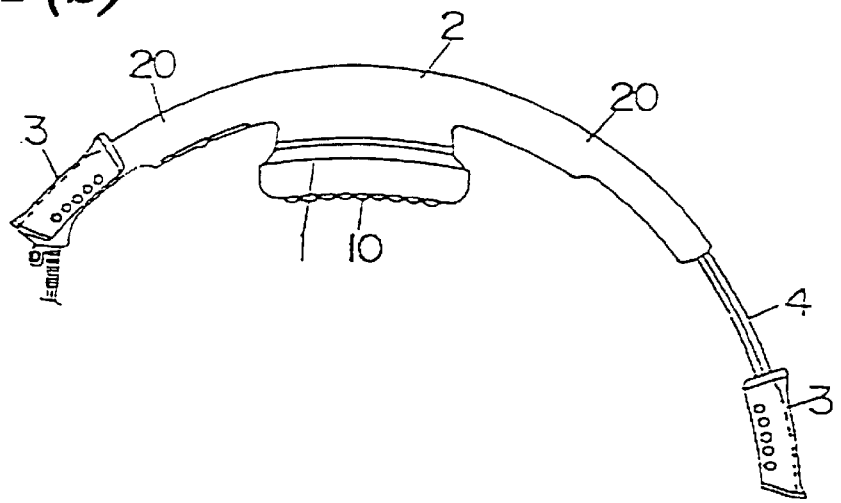
Figure 4:
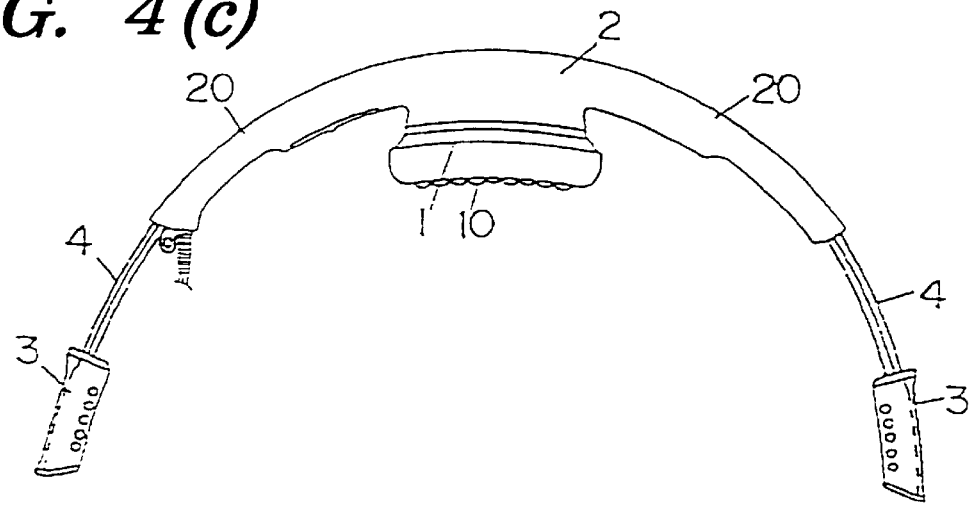

FIGS. 4(*a*)–4(*c*) illustrate three different states in which the arm 4 is extended. Referring to FIGS. 4(*a*)–4(*c*), the grip 3 is attached the end of each arm 4 which telescopically slides in and out from each housing 20. As a result, not only the grips 3 are positioned at the ends of the housings 20 as shown in FIG. 1, but also one or both of the grips 3 can be extended out from their respective housings 20 as shown in FIGS. 4(*a*)–4(*c*). Thus, the positions of the grips 3 can be adjusted by extending the arms 4 in or out from the housings 20. To provide such a function, each housing 20 has a dovetail groove so that each arm 4 is slidably inserted in the respective dovetail groove. The arms 4 therefore are slidable along an extending direction of the housings 20. Furthermore, the arms 4 possess flexibility so that the arms 4 can flex inwardly with respect to the arc of the arc-shaped housings 20.

Accordingly, a user can pull out the extendible arms 4 provided in the housings while holding the grips 3. Then, by pulling and flexing the extended arms 4 toward her intended massage spot, the user can position the massaging portion 10 accurately against the spot in her back, waist or other parts of her body. In addition, because the arms 4 flex toward an intended massaging spot, the massaging apparatus of the present embodiment sufficiently presses the massaging portion 10 against a massaging spot even for users in different sizes. Furthermore, the arc-shape construction of the housings 20 makes it even easier to position the massaging portion 10 against a massaging spot and to pull the arms 4. As a result, the massaging portion 10 is pressed against a massaging spot more effectively with ample force.

Figure 5:
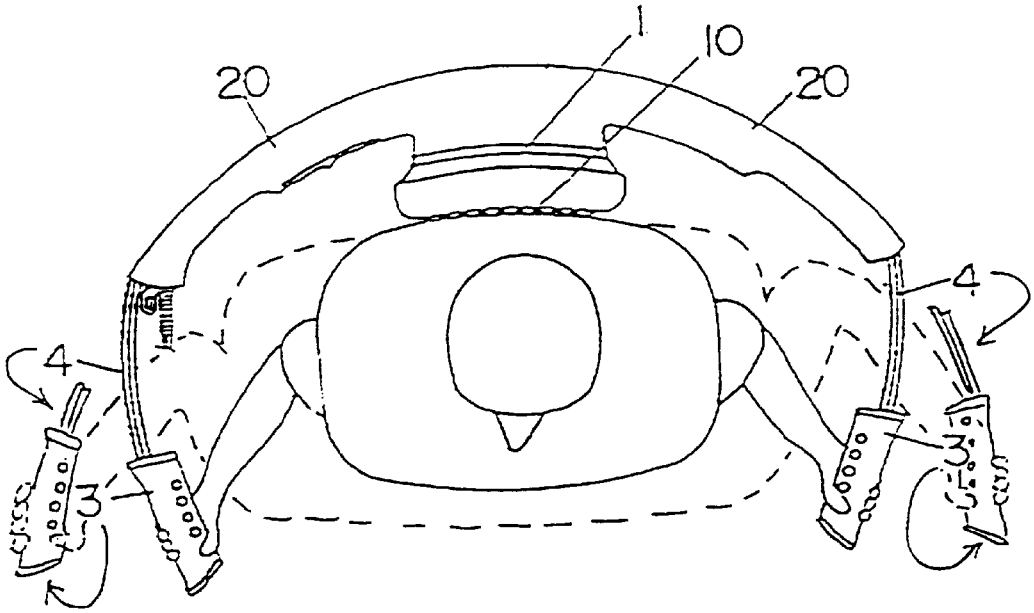
FIG. 5 is a top plan view for explaining the use of the hand-held massaging apparatus shown in FIG. 1.

FIG. 5 is a top plan view for explaining the use of the hand-held massaging apparatus. Referring to FIG. 5, to massage a back or a waist, a user holds onto the grips 3 at the ends of the extended arms 4, and places the massaging portion 10 against an intended massage spot in her back or waist. In this manner, the user can place the massaging portion 10 properly against her intended massage spot without straining her body. Further, because the constructions between the head unit 1 and the right and left grips 3 are the same, the massaging portion 10 would press symmetrically against a massage spot of the user. Hence, the massaging apparatus of the present embodiment evenly massages throughout a massaging area. Preferably, the arms 4 are made of polypropylene or any other materials which are relatively flexible and suitable for the purpose of forming such an arm. These arms 4 are also so constructed that the arms 4 flex relatively toward a massage spot, thereby making a positioning of the massaging portion 10 easy. Similarly, because the arms 4 are constructed to flex as described above, the massaging apparatus of the present embodiment easily permits a massaging of backs and waists in different sizes.

Preferably, the massaging portion 10 has a contacting surface which curves along the extending direction of the housings 20 and which would snuggle against the curvature of a back and thighs. By constructing the massaging portion 10 as such, it becomes easy to massage a wide range and to massage the back of the user which she cannot see, and the user easily slides the massaging portion 10 along the body surface of the user. Preferably, the curvature of the indented contact surface has a radius of 200 mm to 600 mm.

Figure 6:
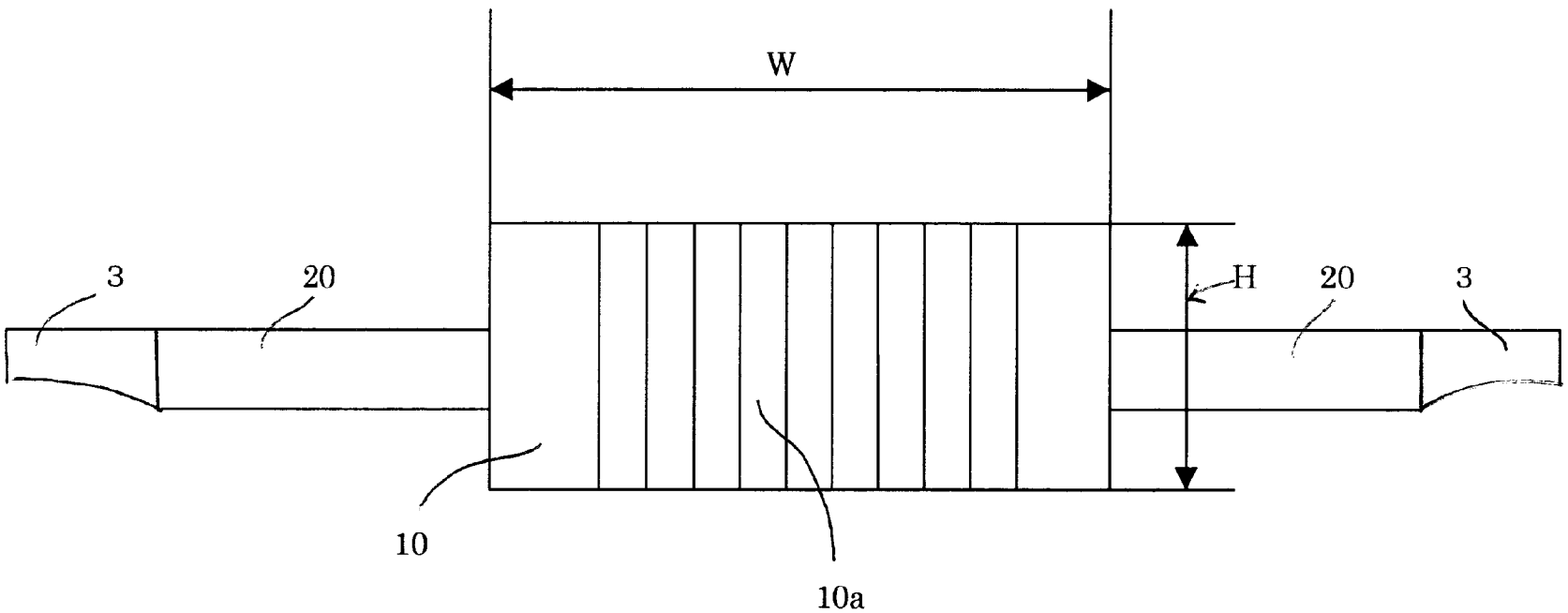
FIG. 6 is a front view of the hand-held massaging apparatus shown in FIG. 1.
Figure 7:
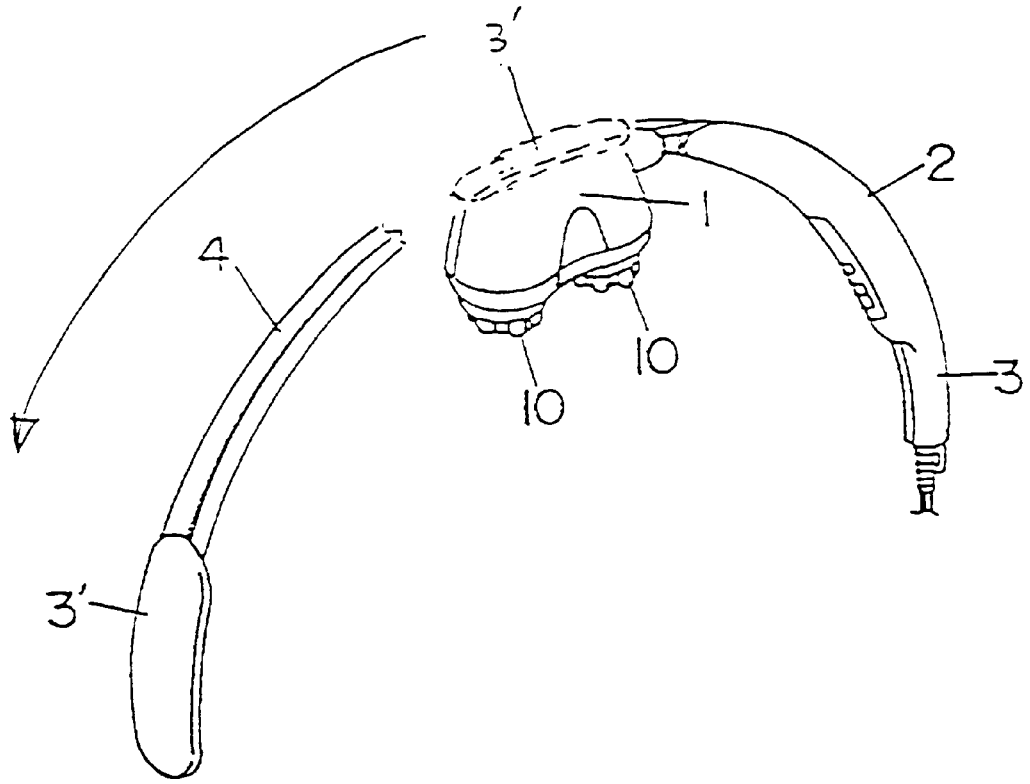
FIG. 7 (PRIOR ART)
FIG. 7 is a perspective view of a conventional massaging apparatus.

Also, referring to FIG. 6, by making a width (W) of the massaging portion 10 longer than a height (H) of the massaging portion 10, the massaging portion 10 snuggles well with user's back, waist and thighs. Preferably, the width (W) of the massaging portion 10 is, for example, between 150 mm to 250 mm.

Referring to FIGS. 1 and 2, an electric cord 9 for a power source is provided at the end of one of the housings 20. Since the electric cord 9 at the end of the housing 20 extends out in a direction parallel to a direction (X) substantially perpendicular to the contacting surface (10*a*) of the massaging portion 10, the electric cord 9 does not contact the user during a massage.

In the present embodiment, the massaging apparatus includes the head unit 1 which has the massaging mechanism and the massaging portion 10 which is to be placed against the user's massaging spot. Further, the massaging apparatus includes the pair of housings 20 and the pair of arms 4 which are flexible to flex toward the user's body and which are movably introduced into the pair of housings 20, respectively. The pair of housings 20 extends from the head unit 1 along opposite directions the right and left sides of the head unit 1. The grip 3 is provided at the end of each arm 4. Accordingly, the massaging apparatus of the present embodiment allows a precise positioning of the massaging portion 10 against a massaging spot and facilitates an effective massage, because the construction between the head unit 1 and one grip 3 and the construction between the head unit 1 and the other grip 3 are symmetrically constructed, and because the arms 3 are flexible and movable.

Further, in the present embodiment, the contacting surface (10*a*) has a concave surface. Accordingly, it becomes easy to massage a wide range and to massage the back of the user which she cannot see, and the user easily slides the massaging portion 10 along the body surface of the user while the contacting surface (10*a*) contacts the body surface.

Further, it becomes easier to position the massaging portion 10 at the massaging spot.

Furthermore, the massaging portion 10 of the massaging apparatus in the present embodiment is properly applied to massaging spots such as a back and a waist, because the width (W) of the massaging portion 10 is longer than the height (H) of the massaging portion 10.

In the present embodiment, because the rotational axis of the eccentric weight 12 is substantially perpendicular to the contacting surface (10*a*), the massaging portion 10 vibrates in a direction substantially parallel to the contacting surface (10*a*). Such a mechanism allows to reduce the size of the massage mechanism for massaging large areas such as a back and a waist at once. Furthermore, because the motor in the massaging mechanism is mounted in the head unit 1 through the elastic body 15, vibration transmitted to the grips 3 through the housings 20 is reduced, and thus a user can hold onto the grips 3 even during a long period of use.

Finally, the electric cord 9 for a power source is provided at the end of one of the housings 20 in a manner that the electric cord 9 extends out in the direction parallel to the direction (X) (see FIG. 1) perpendicular to the contact surface of the massaging portion 10; therefore, the electric cord 9 would not be in the way of a user during a massage.

Obviously, numerous modifications and variations of the present invention are possible in light of the above teachings. It is therefore to be understood that, within the scope of the appended claims, the invention may be practiced otherwise than as specifically described herein.

What is claimed as new and desired to be secured by Letters Patent of the United States is:

1. A massaging apparatus, comprising:

a head unit configured to massage a body of a user and having opposite sides;

a pair of housings connected to said opposite sides respectively and extending in opposite directions from said head unit; and a pair of arms configured to be held by the user and provided to said pair of housings respectively, said pair of arms having an arc-shape along lengths of said pair of arms and being bendable along the lengths.

2. A massaging apparatus according to claim 1, wherein said pair of housings have an arc-shape.

3. A massaging apparatus according to claim 1, wherein said head unit comprises:

a massaging mechanism configured to generate a massaging movement; and a massaging portion configured to be moved by said massaging mechanism.

4. A massaging apparatus according to claim 3, wherein said massaging mechanism comprises:

an eccentric weight; and a motor mounted on said head unit and configured to rotate said eccentric weight.

5. A massaging apparatus according to claim 4, wherein said motor is mounted on said head unit through an elastic member.

6. A massaging apparatus according to claim 5, wherein said elastic member comprises a coil spring.

7. A massaging apparatus according to claim 5, wherein said elastic member comprises an elastomer.

8. A massaging apparatus according to claim 4, wherein said eccentric weight has a rotational axis substantially perpendicular to a contacting surface of said massaging portion in contact with the body to be massaged.

9. A massaging apparatus according to claim 3, wherein said massaging portion includes a contacting surface having a concave shape to contact the body to be massaged.

10. A massaging apparatus according to claim 9, wherein said contacting surface has a radius of substantially 200 to 600 mm.

11. A massaging apparatus according to claim 3, wherein said massaging portion includes a contacting surface having a concave shape to contact the body to be massaged, the contacting surface having a width substantially along said opposite directions and a height perpendicular to a direction along the width, said width being longer than said height.

12. A massaging apparatus according to claim 11, wherein said contacting surface has the width of substantially 150 to 250 mm.

13. A massaging apparatus according to claim 3, further comprising:

an electric cord to supply an electricity to said massaging mechanism, said massaging portion including a contacting surface to contact the body to be massaged, said electric cord extending from an end of one of said pair of housings and along a direction substantially perpendicular to the contacting surface.

14. A massaging apparatus according to claim 3, wherein said massaging portion comprises an elastomer.

15. A massaging apparatus according to claim 1, wherein said pair of arms comprise polypropylene.

16. A massaging apparatus according to claim 1, wherein said pair of arms is movable along said opposite directions.

17. A massaging apparatus according to claim 16, wherein each of said a pair of housings includes a groove into which each of said pair of arms is introduced.

18. A massaging apparatus according to claim 17, wherein said groove comprises a dovetail groove.

19. A massaging apparatus according to claim 1, further comprising a pair of grips, each of said pair of grips being provided at an end of each of said pair of arms.

20. A massaging apparatus according to claim 1, wherein said head unit and said pair of housings are formed integrally.

21. A massaging apparatus according to claim 1, wherein said pair of housings comprise a synthetic resin.

* * * * *